US007861781B2

(12) United States Patent
D'Arcy

(10) Patent No.: US 7,861,781 B2
(45) Date of Patent: Jan. 4, 2011

(54) PUMP DOWN CEMENT RETAINING DEVICE

(75) Inventor: Shane P. D'Arcy, Calgary AB (CA)

(73) Assignee: Tesco Corporation, Houston, TX (US)

( * ) Notice: Subject to any disclaimer, the term of this patent is extended or adjusted under 35 U.S.C. 154(b) by 74 days.

(21) Appl. No.: 12/333,051

(22) Filed: Dec. 11, 2008

(65) Prior Publication Data

US 2010/0147517 A1 Jun. 17, 2010

(51) Int. Cl.
*E21B 33/08* (2006.01)
*E21B 33/16* (2006.01)

(52) U.S. Cl. ..... 166/291; 166/155; 166/156; 166/177.4; 166/193; 166/376

(58) Field of Classification Search ..... 166/155, 166/156, 291, 153, 177.4, 192, 193, 285, 166/376, 378, 386
See application file for complete search history.

(56) References Cited

U.S. PATENT DOCUMENTS

| | | | | | |
|---|---|---|---|---|---|
| 1,606,606 | A | * | 11/1926 | Thomas | 166/156 |
| 2,627,314 | A | | 2/1953 | Baker | |
| 2,662,600 | A | | 12/1953 | Baker | |
| 3,159,219 | A | | 12/1964 | Scott | |
| 3,550,683 | A | | 12/1970 | Comeaux | |
| 3,656,552 | A | * | 4/1972 | Pollock et al. | 166/383 |
| 4,378,838 | A | * | 4/1983 | Ogden et al. | 166/153 |
| 4,589,495 | A | | 5/1986 | Langer et al. | |
| 4,986,361 | A | * | 1/1991 | Mueller et al. | 166/381 |
| 5,165,473 | A | * | 11/1992 | Bode | 166/192 |
| 5,323,858 | A | | 6/1994 | Jones et al. | |
| 5,551,521 | A | | 9/1996 | Vail, III | |
| 5,762,139 | A | * | 6/1998 | Sullaway et al. | 166/291 |
| 6,311,775 | B1 | * | 11/2001 | Allamon et al. | 166/285 |
| 7,044,241 | B2 | | 5/2006 | Angman | |
| 7,328,742 | B2 | | 2/2008 | Slack | |
| 7,428,927 | B2 | | 9/2008 | Vert et al. | |
| 2004/0026126 | A1 | * | 2/2004 | Angman | 175/57 |
| 2004/0060700 | A1 | * | 4/2004 | Vert et al. | 166/291 |
| 2009/0107675 | A1 | * | 4/2009 | Eriksen et al. | 166/285 |

FOREIGN PATENT DOCUMENTS

| | | |
|---|---|---|
| WO | WO01/94739 | 12/2001 |
| WO | WO 2004/031532 A1 | 4/2004 |

* cited by examiner

*Primary Examiner*—George Suchfield
(74) *Attorney, Agent, or Firm*—Bracewell & Giuliani LLP

(57) ABSTRACT

A wall casing cement plug assembly includes a receptacle with an axial passage. The receptacle is pumped to a lower end of the casing string and locked in place. The receptacle has a casing seal that engages the string of casing and a retainer mechanism on its exterior that engages a profile in the string of casing. Cement is pumped through the receptacle by rupturing a blocking device in the axial passage of the receptacle. A wiper plug is pumped down the string casing. The wiper plug has a prong on its lower end that stabs into the axial passage of the receptacle. A latch located in the lower portion of the receptacle locks the wiper plug to the body.

19 Claims, 5 Drawing Sheets

PUMP DOWN CEMENT RETAINING DEVICE

FIELD OF THE INVENTION

This invention relates in general to cementing a casing string within a wellbore, and in particular to a pump down cement retaining device that prevents backflow of cement.

BACKGROUND OF THE INVENTION

Most oil and gas wells are drilled with a drill string comprised of drill pipe. After reaching a certain depth, the drill string is removed and casing is lowered into the wellbore. A cement valve, is normally attached to the lower end of the casing. The cement valve allows cement to be pumped down through the casing and up the annulus surrounding the casing, and prevents backflow of cement from the annulus back into the casing. Another type of casing string, referred to as a liner, may be installed in a similar manner. A casing string extends all the way back to the upper end of the well, while a liner string is hung off at the lower end of a preceding string of casing.

In another drilling technique, the casing is used as part or all of the drill string. The bit may be attached to the lower end of the casing string permanently, in which case it is cemented in place. Alternatively, it may be retrieved after reaching desired depth, such as by using a wireline, drill pipe, or pumping the bit assembly back up the casing. While drilling, the casing string may be rotated by a gripping mechanism and a top drive of the drilling rig. With liner drilling, the liner string serves as the lower end of the drill string, and a string of drill pipe is attached to upper end of the liner string.

In casing and liner drilling, if the bottom hole assembly, which includes a drill bit and optionally measuring instruments and steering devices, is to be retrieved before cementing, the operator will install a cement valve at the lower end of the liner after retrieval of the bottom hole assembly. The cement valve may be lowered into place on a wire line or a string of drill pipe and locked to a profile at the lower end depth of the liner string. Also, it is has been proposed to pump the cement valve down the casing, rather than convey it on a wire line. The cement valve may have a flapper valve to prevent back flow of cement. It may also have a frangible barrier to allow the cement valve to be pumped down the casing string. Once in place, increased fluid pressure causes the barrier to break and the fluid to flow out the lower end of the cement valve.

It has also been proposed to pump a receptacle down the casing string and latch it into a profile at the lower end prior to cementing. The receptacle has a passage that allows the downward flow of cement, but does not have a valve to prevent backflow. At the conclusion of cementing, a wiper plug or prong is pumped down into engagement with the receptacle. The prong stabs into the upper end of the receptacle to form a seal and retain the plug to prevent backflow of cement.

After the cement is cured, if the operator intends to drill the well deeper, the drill string must drill through the receptacle and wiper plug. It is thus desirable to make the receptacle and wiper plug of easily drillable materials. These materials must meet the requested specifications of the tools.

SUMMARY OF INVENTION

The method of this invention utilizes a receptacle that is positioned at the lower end of the casing string. A wiper plug is pumped down the string of casing following the pumping of cement. The wiper plug has a prong on its end with a seal that seals within a lower portion of the receptacle. The positioning of the seal places the receptacle under a compressive force when a pressure differential exists due to uncured cement in the annulus. Since the force is compressive, many of the components of the receptacle can be made of more easily drillable materials, such as plastic and resin composites, than in the prior art design. The prior art design had to accommodate at least some tensile forces.

In the preferred embodiment, the lower end of the prong is substantially flush with a lower end of the axial passage through the receptacle once locked in place. Preferably, the seal is also located at the lower end of the axial passage. The latching members of the prong and receptacle may comprise a ratchet sleeve and a grooved profile.

DETAILED DESCRIPTION OF INVENTION

Figure 1:
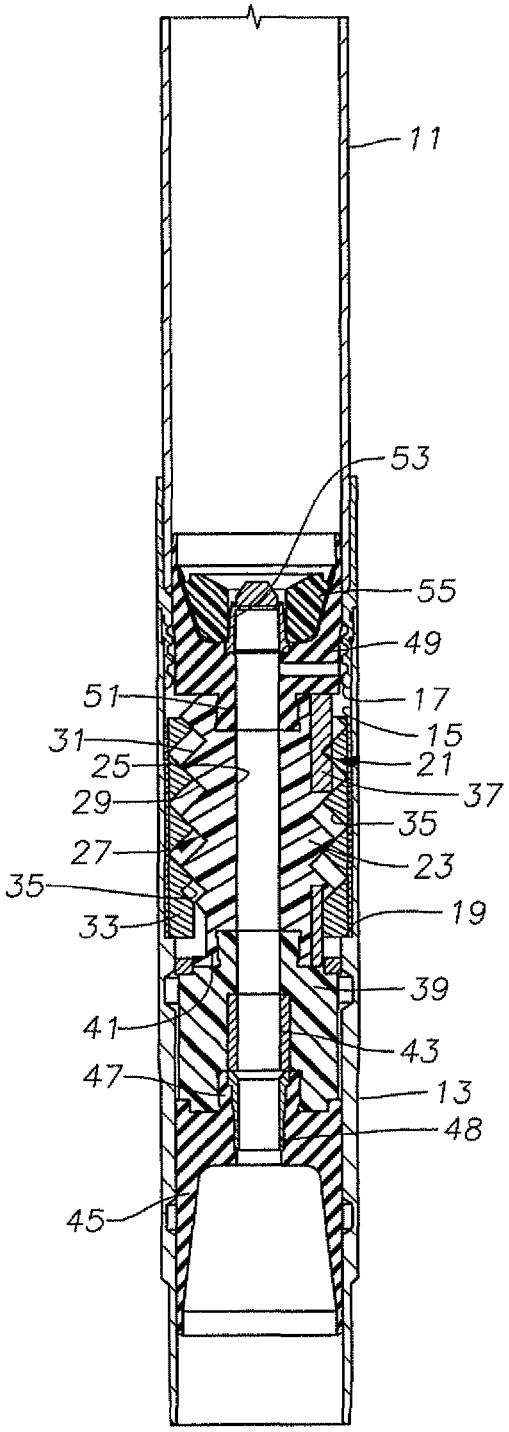
FIG. 1 is a sectional view of a receptacle installed in a profile at the lower end of a string of casing in accordance with this invention.

Referring to FIG. 1, a string of casing 11 comprises tubular members secured together by threads for installation in a wellbore. The term "casing" is used broadly herein to include also a liner string, which is normally constructed the same as casing but does not extend fully to the surface, rather its upper end is hung off near the lower end of the preceding string of casing.

A lower or profile sub 13 is attached to the lower end and forms part of the string of casing 11. Profile sub 13 has number of internal grooves that in this embodiment were used previously to secure a bottom hole assembly (not shown) for drilling. Profile sub 13 also has an annular recess 15 located therein that has a larger inner diameter than the inner diameter of the remaining portion of the string of casing 11. Recess 15 is defined by an upper shoulder 17 and a lower shoulder 19.

A cement plug receptacle 21 is shown latched into profile sub 13. Cement plug receptacle 21 has a body 23 with an axial passage 25 extending through it. Body 23 has at least one and optionally a plurality of circumferential grooves 27 on its exterior. In this embodiment, grooves 27 are configured in a triangular fashion, resulting in a downward-facing conical flank 29 intersecting an upward-facing conical flank 31.

When viewed in cross-section, flanks 29 of grooves 27 are parallel to each other and flanks 31 are parallel to each other.

An outward-biased collar 33 surrounds body 23 at grooves 27. Collar 33 is of a resilient material and is split so as to radially expand and contract. Collar 33 has at least one and optionally a plurality of internal grooves 35 for mating with grooves 27 of body 23. The resiliency of collar 35 causes it to spring outward from grooves 27 when it reaches profile sub recess 15. As receptacle 21 moves down casing 11, prior to reaching recess 15, the outer diameter of collar 33 will slidingly engage the inner diameter of casing 11. Anti-rotation keys 37, one at the upper end and one at the lower end of body 23, engage collar 33 to prevent collar 33 from rotating relatively to body 23. Grooves 35 have same configuration as grooves 27, but body 23 is capable of axial movement from a lower position relative to collar 33, shown in FIG. 4, to an upper position, shown in FIG. 5. In the lower position, downward-facing flanks 29 of body grooves 27 are engagement with collar grooves 35 but upward-facing flanks 31 are not in engagement with collar grooves 35. In the upper position of FIG. 5, upward-facing flanks 31 are engagement with grooves 35, but downward-facing flanks 29 are not in engagement with grooves 35.

Referring still to FIG. 1, body 23 has a lower body extension 39 that has a threaded neck 41 that secures it to the lower end of body 23. Lower body extension 39 could optionally be integrally formed with body 23. Axial passage 25 extends through lower body extension 39. A latch member sleeve 43 with internal grooves is mounted within lower body extension 39.

A lower seal 45 is attached to the lower end of lower body extension 39 by a threaded neck 47. Lower seal 45 is illustrated as a cup seal, having a downward-facing concave interior; but it could be other types. Pressure acting on the lower side of lower seal 45 pushes seal 45 outward and upward into sealing engagement with profile sub 13. A cylindrical seal member 48 is preferably located in the portion of axial passage 25 that extends through lower seal 45.

Figure 2:
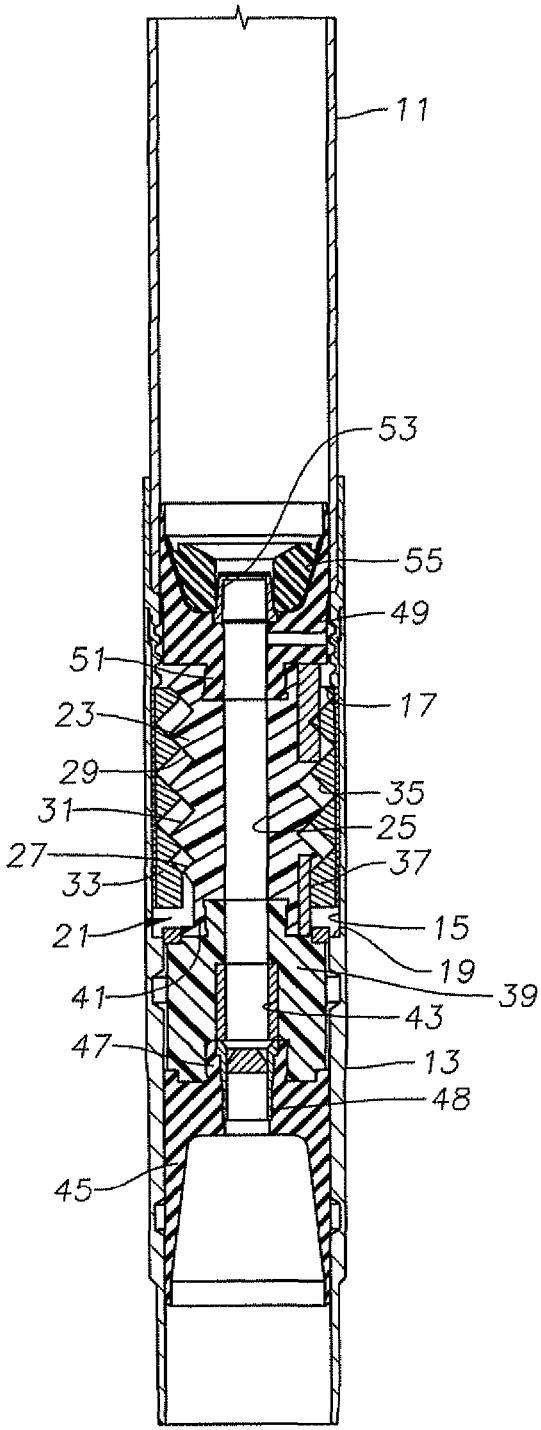
FIG. 2 is a sectional view of the receptacle of FIG. 1, with the burst disk broken to allow fluid to be pumped through the axial passage.

An upper seal 49 is mounted to the upper end of body 23 by a threaded neck 51 in this example. Upper seal 49 may have the same general shape as lower seal 45. Axial passage 25 extends through upper seal 49 but it is initially closed by a frangible barrier, which comprises a burst disk 53 in this example. Burst disk 53 closes axial passage 25 until the differential pressure acting on it exceeds a selected level, at which time it breaks or ruptures to allow flow through axial passage 25. Burst disk 53 is secured to upper seal 49 by a shear cylinder retainer 55. FIG. 1 shows burst disk 53 as initially installed and FIG. 2 shows burst disk 53 after being ruptured. Rather than the barrier device being a rigid frangible member, burst disk 53 could be a flexible elastomeric member or diaphragm that ruptures, or other types of devices.

Figure 3:
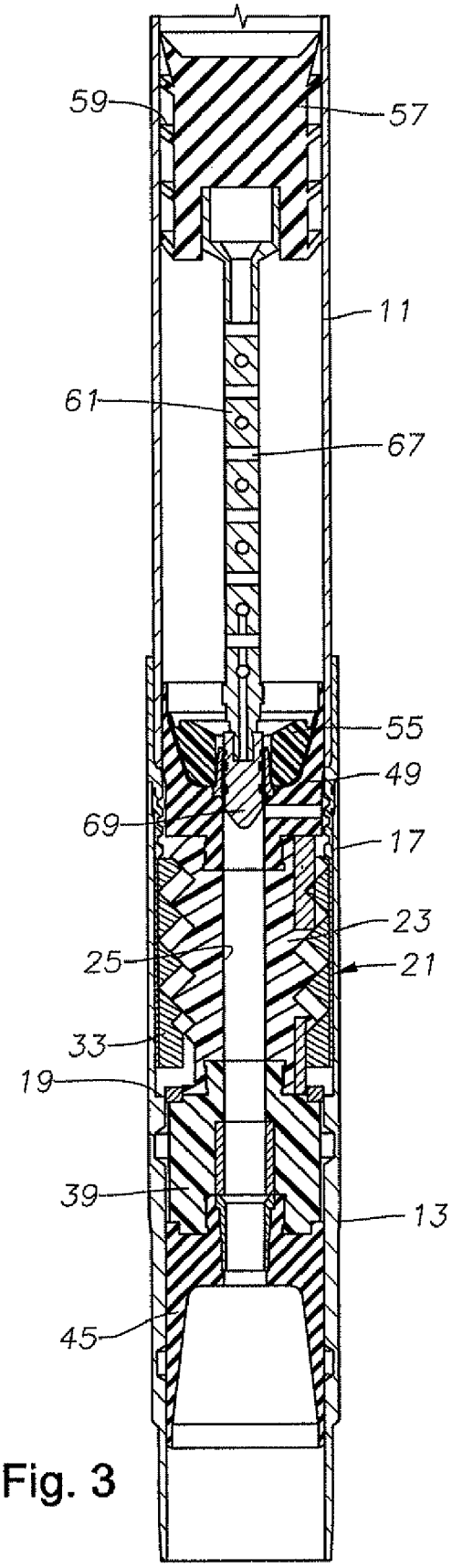
FIG. 3 is a sectional view of the receptacle of FIG. 1, showing a wiper plug and prong being pumped down the string of casing.
Figure 7:
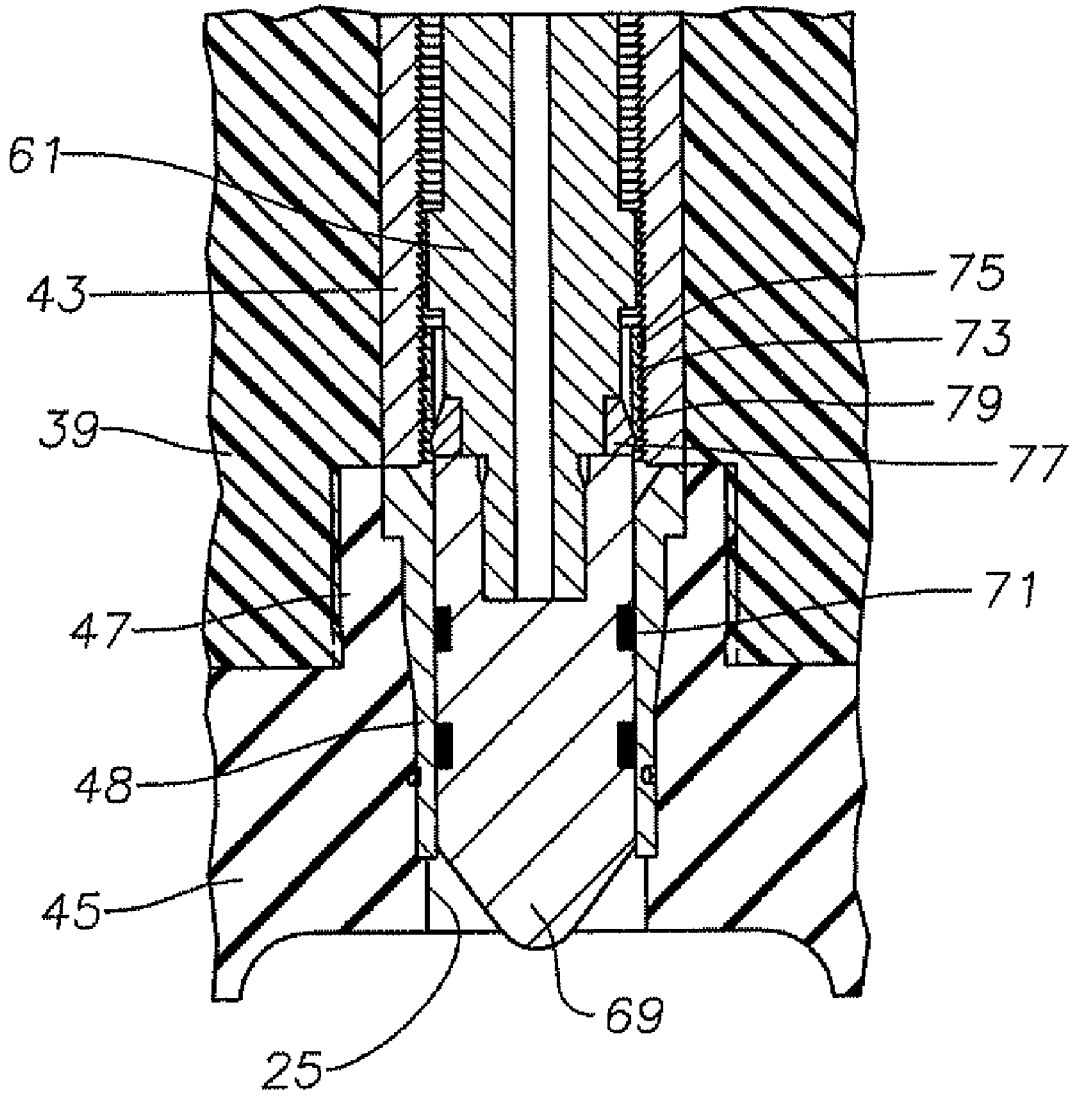
FIG. 7 is a further enlarged sectional view of a lower portion of the wiper plug prong landed within the receptacle as shown in FIGS. 4 and 5.

FIG. 3 shows a wiper plug 57 being pumped down following the dispensing of cement. Wiper plug 57 has flexible ribs 59 on its outer side that seal against the inner diameter of casing 11 as it moves downward. A prong 61 is mounted to the lower end of wiper plug 57 and protrudes downward. Prong 61 comprises a rod located on the axis of wiper plug 57. A plurality of transverse ports 67 optionally may be formed along its length. A nose 69 is attached to the lower end of prong 61. Referring to FIG. 7, nose 69 has one or more seal 71 that extends around it. Seals 71 seal against seal sleeve 48 located within lower seal 45. A latch member comprising a ratchet sleeve 73 is mounted just above nose 69. Ratchet sleeve 73 is a split cylindrical sleeve that is biased outward due to its internal resiliency. Ratchet sleeve 73 has grooves 75 on its exterior that will mate with the grooves in latch sleeve 43. Grooves 75 and the mating grooves in latch sleeve 43 are configured to allow downward movement of prong 61 but not upward movement. During downward movement, the saw-tooth shape of grooves 75 in ratchet sleeve 73 cause ratchet sleeve 73 to retract and expand.

An annular retainer 77 located below ratchet sleeve 73 on the upper end of nose 69 has a tapered surface 79 on its upper end that faces upward and outward for urging ratchet sleeve 73 outward into tighter engagement due to internal pressure acting against nose seals 71.

Preferably, most, if not all the components of cement plug receptacle 21 and wiper plug 57 are constructed of easily drillable materials to allow the operator to readily drill out the assembly after the cementing operation is over and the cement is secured. These materials may include composite materials, such as resin reinforced fiber as well as plastic materials. They may also include metallic materials such as aluminium.

In operation, after drilling to a desired depth and retrieving the bottom hole assembly (not shown), the operator places cement plug receptacle 21 into the upper end of the string of casing 11 and applies fluid pressure to casing 11 to pump it downward, typically with water. When cement plug receptacle 21 reaches recess 15, the outward-biased collar 33 springs outward and secures cement plug receptacle 21 to profile sub 13, as shown in FIG. 1. Once in engagement, downward movement is prevented by upward-facing shoulder 19 and upward movement is prevented by downward-facing shoulder 17.

Figure 4:
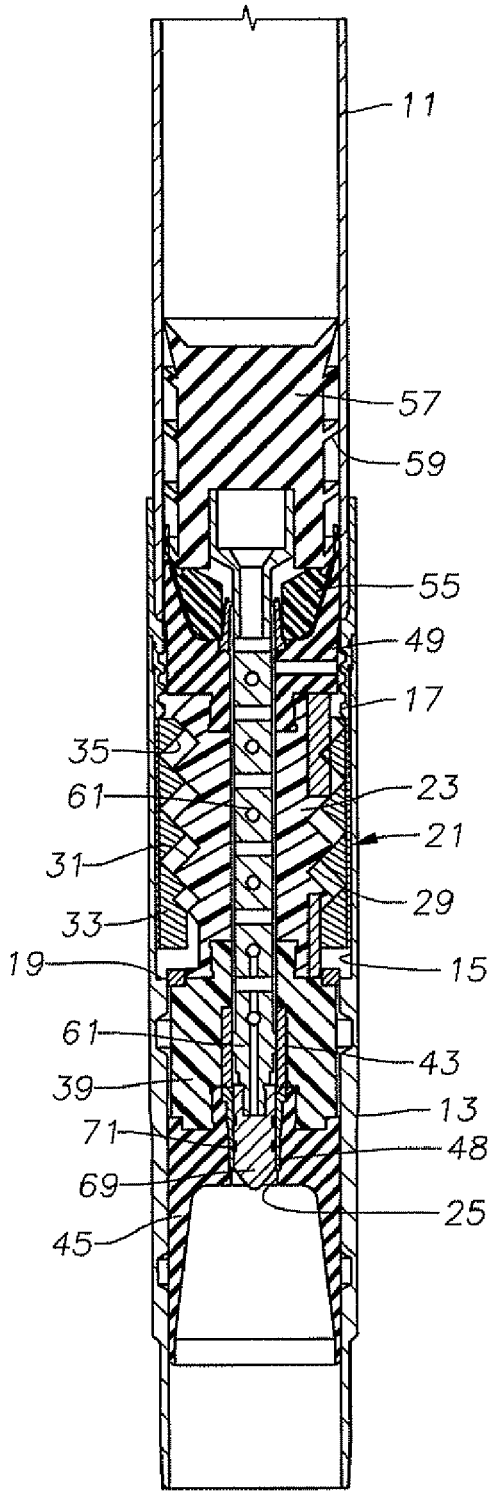
FIG. 4 is a sectional view of the wiper plug and receptacle of FIG. 3, but showing the prong fully engaged with the receptacle.

Continued fluid pressure after cement plug receptacle 21 has landed shears burst disk 53, as shown in FIG. 2. Once burst disk 53 ruptures, the operator may pump cement through casing 11, which flows through axial passage 25 and up the annulus surrounding casing 11. When the desired quantity of cement has been dispensed, the operator places wiper plug 57 in casing string 11, as shown in FIG. 3, and pumps wiper plug 57 downward, normally with water. Wiper plug 57 pushes the cement in casing string 11 downward through axial passage 25. Eventually, prong 61 will stab into axial passage 25, as shown in FIG. 4, and wiper plug 57 will land on retainer 55. At this point, the tip of wiper plug nose 69 will be located substantially flush with the lower end of axial passage 25. Seals 71 on nose 69 will be sealing engagement with seal sleeve 48 (FIG. 7). Ratchet sleeve 73 will be in locking engagement with latch sleeve 43. Downward-facing flanks 29 on body 23 will be in engagement with grooves 35 in collar 33. Most, if not all, of ribs 59 of wiper plug 57 will be located above receptacle 21 and do not perform any latching function or any sealing function against upward acting pressure.

Figure 5:
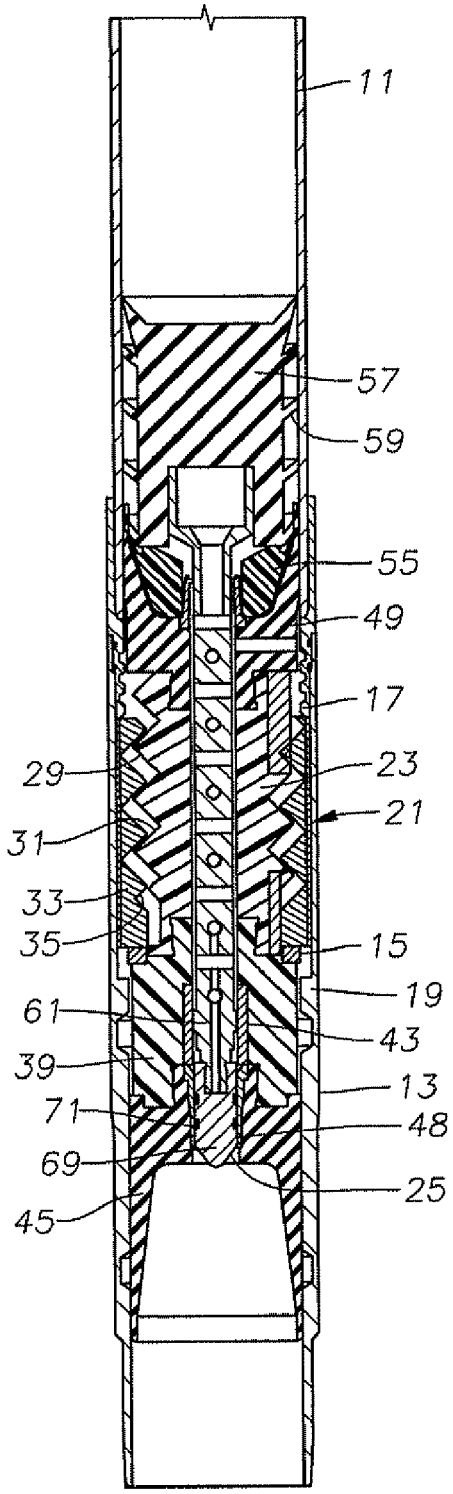
FIG. 5 is a sectional view of the wiper plug, prong and receptacle of FIG. 4, but showing fluid pressure acting upward on the lower end of the receptacle.

The operator may then release the fluid pressure from above wiper plug 57. The weight of the cement in the casing annulus tends to cause it to flow back upward into casing string 11. Wiper plug 57 and body 23 will initially move upward slightly in unison due to the differential pressure force as shown in FIG. 5. This upward movement will stop once upward-facing flanks 31 on body 23 engage grooves 35 in collar 33, as shown in FIG. 5. The load path due to the pressure of the cement in the annulus passes through lower seal 45, lower body extension 39 and body 23 into collar 33, which transfers the load to profile sub 13 through upper shoulder 17. The load path also passes from nose 69 through latch sleeve 43 into lower body extension 39. Lower body extension 39, body 23, nose 69 and collar 33 will be in compression. No components of receptacle 21 or wiper plug 57 will be in tension as a result of the upward acting pressure.

After the cement has cured, the operator may run a new drill string, which could comprise drill pipe or a smaller diameter string of casing. A drill bit on the lower end will drill out cement plug receptacle 21, leaving only profile sub 13.

Figure 6:
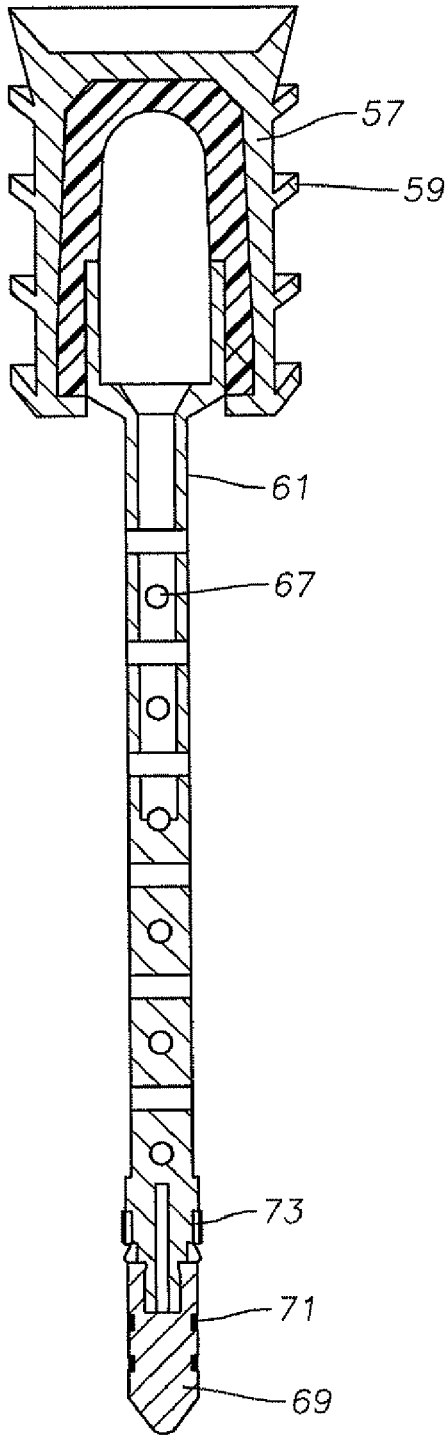
FIG. 6 is an enlarged sectional view of the wiper plug and prong of FIG. 3.
Figure 8:
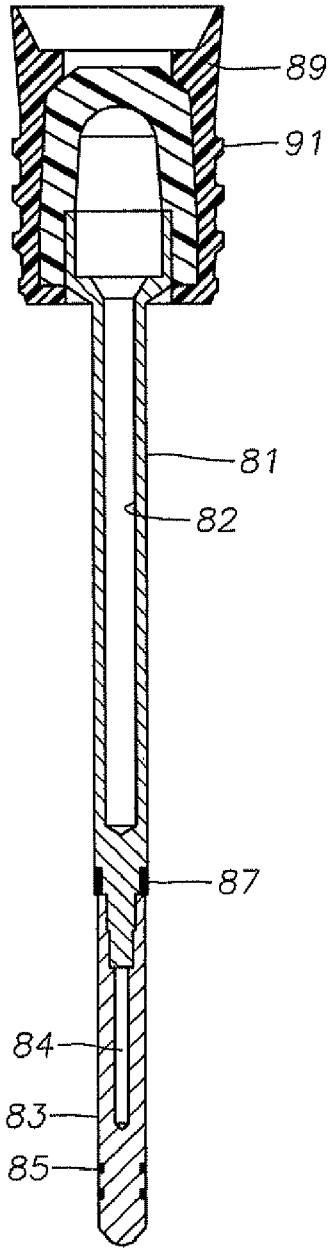
FIG. 8 is a sectional view of an alternate embodiment of a wiper plug and prong.
Figure 9:
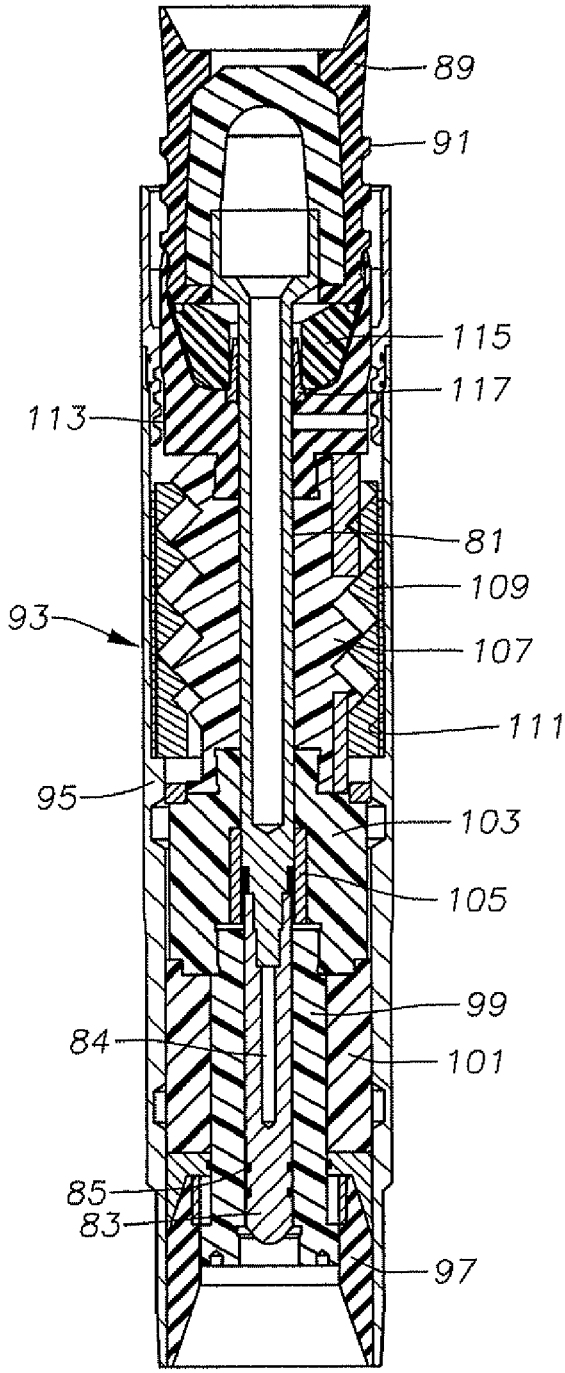
FIG. 9 is a sectional view of an alternate embodiment of a receptacle, and showing the wiper plug and prong of FIG. 8 installed.

An alternate embodiment is shown in FIGS. 8 and 9. Referring to FIG. 8, prong 81 differs from the first embodiment in that is does not have holes such as ports 67 (FIG. 2) extending through it perpendicular to its axis. Also, its internal cavity 82 is deeper than the internal cavity of prong 61 (FIG. 6). Nose 83 is longer than nose 69 of the first embodiment; however, seals 85 are positioned about the same distance from the lower end as seals 71 on nose 69 of the first embodiment. Nose 83 may have an axially extending internal cavity 84, as shown. A split ratchet ring 87 is attached near the lower end of prong 81 as in the first embodiment. Wiper plug 89 on the upper end of prong 81 has seal ribs 91 that protrude radially less distance from the body of wiper plug 89 than seal ribs 59 of the first embodiment.

Referring to FIG. 9, receptacle 93 is shown anchored in a profile sub 95 that may the same as lower sub 13 of the first embodiment. Receptacle has a lower cup seal 97 that differs from lower seal 45 (FIG. 1) in that it is carried on a tubular cup mandrel 99 of a more rigid material than the material of seal 97. An annular load ring 101 encircles cup mandrel 99 for transmitting upward compressive force from lower seal 97 to a tubular extension member 103. The first embodiment does not have a load ring. The upper end of cup mandrel 99 is secured to extension member 103, and the lower end of cup mandrel 99 extends below load ring 101 into lower seal 97. Ratchet or internally grooved sleeve 105 is mounted within extension member 103 for engagement with ratchet ring 87 on prong 81 as in the first embodiment.

Body 107 is attached to the upper end of extension member 103 and may be constructed the same as body 23 of the first embodiment. A collar 109 encircles body 107 and springs outward into a recess 111 of profile sub 95 as in the first embodiment. An upper cup seal 113 similar to upper seal 49 (FIG. 1) is mounted on top of body 107. A seat 115 containing a burst disc 117 is mounted within upper seal 113. The operation of the embodiment of FIGS. 8 and 9 is the same as the operation of the first embodiment.

While the invention has been shown in only two of its forms, it should be apparent to those skilled in the art that is not so limited, but is susceptible to various changes without departing from the scope of the invention.

The invention claimed is:

1. A well casing cement plug assembly, comprising:

a receptacle for location at a lower portion of a string of casing, the receptacle having an axial passage therethrough;

a wiper plug adapted to be pumped down the string of casing into engagement with the receptacle;

a prong on the wiper plug that stabs into the axial passage, the prong having an axial passage seal that blocks the axial passage;

the prong and the receptacle having cooperative latch members located in a lower portion of the receptacle to lock the wiper plug to the receptacle; wherein the receptacle comprises:

a body through which the axial passage extends;

a lower seal mounted to a lower end of the body and through which the axial passage extends; and wherein the latch members are located within the body and the axial passage seal is located within the lower seal when the prong is locked to the receptacle.

2. The cement plug assembly according to claim 1, wherein the prong has a lower end that is located in a lower end portion of the axial passage while locked to the receptacle.

3. The cement plug assembly according to claim 1, wherein the latch members comprise a ratchet sleeve that mates with a grooved profile, one of the ratchet sleeve and the grooved profile being within the axial passage and the other on the prong.

4. A well casing cement plug assembly, comprising:

a receptacle for location at a lower portion of a string of casing, the receptacle having an axial passage therethrough;

a wiper plug adapted to he pumped down the string of casing into engagement with the receptacle;

a prong on the wiper plug that stabs into the axial passage, the prong having an axial passage seal that blocks the axial passage;

the prong and the receptacle having cooperative latch members located in a lower portion of the receptacle to lock the wiper plug to the receptacle;

at least one groove on an exterior portion of the receptacle; and an outward biased resilient collar mounted around the receptacle, the collar having a mating groove within its interior.

5. The cement plug assembly according to claim 4, wherein the axial passage seal is located at a lower end portion of the axial passage while the prong is locked to the receptacle.

6. The cement plug assembly according to claim 4, wherein the receptacle comprises:

a body through which the axial passage extends;

the body being formed substantially of a nonmetallic material; and the latch member within the body is located at a lower end of the axial passage so as to place the body in a compression when a greater pressure exists below the body than above.

7. A well casing cement plug assembly, comprising:

a receptacle with an axial passage therethrough;

a releasable barrier device in the axial passage;

a casing seal mounted to the receptacle to engage a string of casing, the barrier device and the casing seal enabling the receptacle to be pumped down the string of casing to a landing location;

a retainer mechanism on the exterior of the receptacle that engages the string of casing at the landing location and retains the receptacle;

the barrier device being selectively releasable to allow pumping of cement through the string of casing, the axial passage and up a casing annulus surrounding the casing;

a wiper plug having a wiper plug seal that engages the string of casing, enabling the wiper plug to be pumped down the string of casing into engagement with the receptacle following the cement;

a prong on the wiper plug that stabs into the axial passage, the prong having an axial passage seal, blocking upward flow of cement into the axial passage from the casing annulus; and the prong and the receptacle having a cooperative latch members located in a lower portion of the receptacle to lock the wiper plug to the body.

8. The cement plug assembly according to claim 7, wherein the latch members comprise a ratchet sleeve that mates with a grooved profile, one of the ratchet sleeve and grooved profile being within the axial passage and the other on the prong.

9. The cement plug assembly according to claim 7, wherein the latch members comprise a ratchet sleeve on the prong that mates with a grooved profile within the axial passage, the grooved profile being located at a lower end portion of the body.

10. The cement plug assembly according to claim 7, wherein the barrier device comprises a frangible disk.

11. The cement plug assembly according to claim 7, wherein:

the casing seal comprises an upward-facing cup seal at an upper end of the receptacle; and wherein the cement plug assembly further comprises:

a downward-facing cup seal at a lower end of the receptacle for sealing against upward flow in the string of casing; and wherein the axial passage extends through the downward-facing cup seal and the axial passage seal seals against the portion of the axial passage within the downward-facing cup seal.

12. The cement plug assembly according to claim 7, wherein the receptacle comprises:

a body through which the axial passage extends;

a lower seal mounted to a lower end of the body; and wherein one of the latch members is located within the body; and the axial passage seal is located within the lower seal when the prong is locked to the receptacle.

13. The cement plug assembly according to claim 7, wherein the retainer mechanism comprises:

at least one groove on an .exterior portion of the receptacle; and an outward biased resilient collar mounted around the receptacle, the collar having a mating groove within its interior.

14. A method of cementing a well, comprising:

(a) pumping a receptacle down a string of casing to a selected location and securing the receptacle at the location;

(b) pumping cement through an axial passage provided in the receptacle and up an annulus surrounding the string of casing;

(c) attaching a prong to a wiper plug, and after the cement has been pumped through the axial passage, pumping the wiper plug down the string of casing;

(d) stabbing the prong into the axial passage and sealing a portion of the prong to the axial passage; and (e) latching the prong to a lower portion of the receptacle so that uncured cement in the casing annulus places a compressive force on the receptacle.

15. The method according to claim 14, wherein step (c) comprises sealing the prong to a lower end portion of the axial passage.

16. The method according to claim 14, further comprising:

providing the receptacle with a body and a lower seal at a lower end of the body; and wherein step (d) comprises engaging an axial passage seal on a lower end of the prong with a portion of the axial passage within the lower seal.

17. The method according to claim 14, further comprising:

providing the body with a latch member in the axial passage at a lower end of the body; and providing the prong with a mating latch member above the axial passage seal; and step (e) comprises:

engaging the latch member on the prong with the latch member in the body.

18. The method according to claim 14, wherein step (d) comprising landing the prong in the receptacle at a point where a lower end of the prong is located in a lower end portion of the axial passage.

19. The method according to claim 14, wherein:

step (a) comprises closing the axial passage while pumping down the receptacle; and step (b) comprises opening the axial passage when pumping down the cement.

* * * * *